United States Patent [19]

Katagiri et al.

[11] 4,286,517

[45] Sep. 1, 1981

[54] PRINTER MAGNETIC INTERFERENCE PREVENTION SYSTEM

[75] Inventors: Shigenobu Katagiri; Hiroshige Nakano; Kazuo Matsuzaki, all of Katsuta, Japan

[73] Assignee: Hitachi Koki Company Limited, Tokyo, Japan

[21] Appl. No.: 57,148

[22] Filed: Jul. 12, 1979

[51] Int. Cl.[3] ..... B41J 1/20

[52] U.S. Cl. ..... 101/93.14; 101/93.29; 101/93.09; 361/191

[58] Field of Search ..... 101/93.02, 93.03, 93.29, 101/93.34, 93.48, 93.09, 93.14; 361/159, 166, 167, 191, 192, 193

[56] References Cited

U.S. PATENT DOCUMENTS

| | | | |
|---|---|---|---|
| 3,633,496 | 1/1972 | Kearns | 361/191 X |
| 3,855,923 | 12/1974 | Foley | 101/93.29 |
| 3,899,968 | 8/1975 | McDevitt | 101/93.14 X |
| 3,952,648 | 4/1976 | Sery et al. | 101/93.14 |

OTHER PUBLICATIONS

Blythe et al., IBM Tech. Discl. Bulletin, vol. 20, No. 4, Sep. 1977, pp. 1319–1320.

Gregory et al, IBM Tech. Discl. Bulletin, vol. 20, No. 1, Jun. 1977, pp. 90–95.

*Primary Examiner*—Edward M. Coven

*Attorney, Agent, or Firm*—Sughrue, Mion, Zinn, Macpeak & Seas

[57] ABSTRACT

A magnetic interference prevention system in a printer comprising a plurality of print hammers whose hammering surfaces are disposed in a straight line and a plurality of printing magnets arranged adjacent one another to drive each of the print hammers respectively. In this system when a signal to drive a first printing magnet for a column is provided the driving of at least one of two printing magnets adjacent to the first printing magnet is inhibited for a predetermined period of time. This will prevent three adjacent printing magnets from being driven substantially at the same time.

7 Claims, 8 Drawing Figures

PRINTER MAGNETIC INTERFERENCE PREVENTION SYSTEM

BACKGROUND OF THE INVENTION

This invention relates to printers such as line printers. In particular, it relates to a magnetic interference preventing device suitable for preventing the mutual magnetic interference between adjacent printing magnets adapted to drive their respective printing hammers.

In order to prevent character misregistration due to the mutual magnetic interference between adjacent printing magnets, a conventional printer employs a method in which printing magnets themselves free of magnetic interference are used. However, this method is disadvantageous in that such individual printing magnets are expensive.

SUMMARY OF THE INVENTION

Accordingly, in view of the aforementioned disadvantage in the prior art, an object of the invention is to provide a magnetic interference preventing device in which the mutual magnetic interference between adjacent printing magnets is effectively prevented to eliminate the drawback in the prior art.

Yet another object of this invention is to accomplish such results using printing magnets obtainable at relatively low cost.

If three adjacent elements of a plurality of printing magnets are driven substantially at the same time, the flight time of a printing hammer energized by the center of the three printing magnets is changed by the effect of magnetic interference. According to this invention, when one of the outermost printing magnets among the three printing magnets is driven, driving of the other is inhibited for a predetermined time, to prevent the magnetic interference which may change the flight time of the printing hammer energized by the central printing magnet.

This invention will be described in greater detail with respect to the accompanying drawings and the description of the preferred embodiment.

BRIEF DESCRIPTING OF THE DRAWINGS

DESCRIPTION OF THE PREFERRED EMBODIMENT

Figure 1:
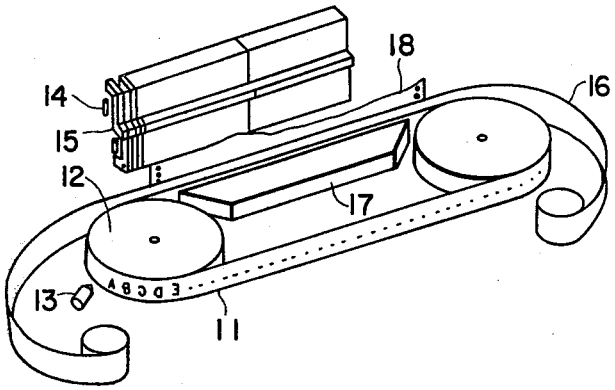
FIG. 1 is a perspective view showing a part of a printing mechanism in a printer having a horizontal type carrier.

FIG. 1 shows a part of a printing mechanism employed in a printer having a horizontal type carrier. A type belt 11 is horizontally moved by belt drive pulleys 12. Character marks in a correspondence of 1:1 to the printing types on the type belt 11 are detected by a character mark detector 13, so that a type confronting a print hammer 15 can be discriminated at all times. In printing, print scanning is carried out, so that printing data is compared with a type. If the printing data coincides with the type, a printing magnet 14 for that column is driven to energize the respective print hammer 15. The printing hammer 15 thus energized operates to strike a printing sheet 18 through an ink ribbon 16 against the selected type on the type belt 11 the back of which is supported by a platen 17. Thus, a desired character is printed in a desired place or position on the printing sheet 18.

Figure 2:
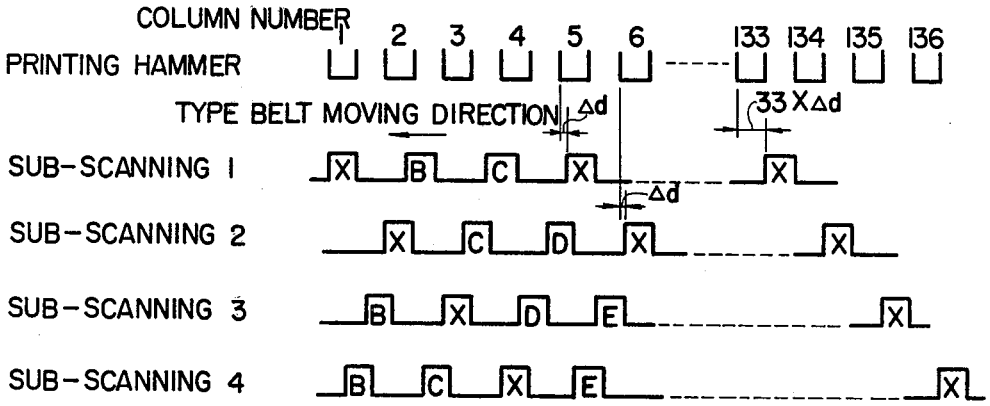
FIG. 2 is a diagram showing the confrontation relation between printing hammers and types.

The aforementioned print scanning technique will now be described in detail with reference to the printer in which this invention is practiced. FIG. 2 shows the positional relationship between print hammers 15 and types in the printer, while FIG. 3 indicates the driving timing of the print hammers 15. In practice, the position of a type must be shifted to the right, as viewed in FIG. 2, as much as the flight time of a print hammer 15. However, for simplification in this description, the printing hammer flight time is disregarded.

One print scanning is carried out during the time interval which elapses from the instant that the first column print hammer 15 completely confronts a type until the next type completely confronts the first column print hammer 15. This print scanning is commenced when the character mark is detected by the character mark detector 13. Four sub-scannings are carried out during one print scanning, so that the printing data is compared with a type, and upon coincidence the relevant printing hammer 15 is energized to print the character.

As is apparent from FIG. 2, print hammers 15 confront types in a ratio of approximately 5:4; however, the former is not completely confronted with the latter that is, they are confronted with each other with a slight deviation or shift. More specifically, when the first column print hammer 15 confronts a type, a type confronting the fifth column print hammer 15 is displaced by $\Delta d$ from the fifth column print hammer 15. If the movement speed of the type belt 11 is represented by "v", then the fifth column print hammer 15 will completely confront the type at the time $\Delta d/v$ ($=\Delta t$) after the 1st column print hammer 15 has completely confronted the type. Similarly, a type which is to confront the 9th column print hammer 15 will completely confront the 9th column print hammer 15 at the time $\Delta t$ after a type has completely confronted the 5th place print hammer.

Thus, types will confront the 1st, 5th, 9th, 13th . . . 129th and 133rd column print hammers 15 at time intervals of $\Delta t$. For each of these columns, a comparison between printing data and a type is carried out, and upon concidence, the relevant print hammer is energized for printing. This is sub-scanning 1 as shown in FIG. 2.

After comparison between printing data and a type is conducted for the 133rd column, sub-scanning 2 is carried out. In this sub-scanning, starting at the 2nd column print hammer 15 comparisons between printing data and types are successively carried out for the 2nd 6th, 10th, 14th . . . 130th and 134th columns, similarly as in the case of sub-scanning 1. Sub-scannings 3 and 4 are also carried out similarly as described above.

Figure 3:
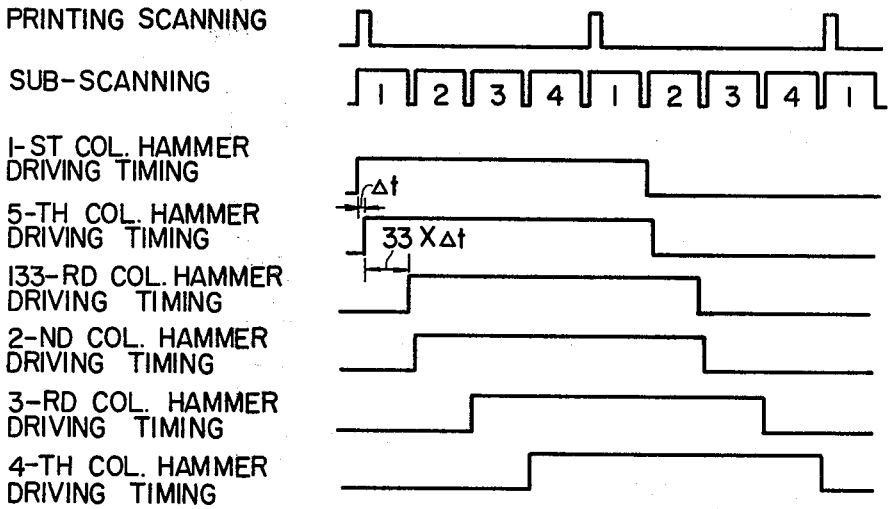
FIG. 3 is a timing chart indicating printing hammer driving times.

In FIG. 2, type elements which are confronted with printing hammers in each sub-scanning are indicated by "X". FIG. 3 indicates the driving timing of the print hammers 15 effected in the case where, with respect to columns where confrontation has been effected, printing data coincide with types. However, it should be noted that FIG. 3 indicates a case where the invention is not applied.

As is clear from the above description, all of the print hammers 15 are energized at different time instants.

The column numbers of the print hammers 15 with which confrontation is effectuated in the sub-scanning operations are summarized as follows:

Sub-scanning 1—1, 5, 9, 13, 17—129, and 133;
Sub-scanning 2—2, 6, 10, 14, 18—130, and 134;
Sub-scanning 3—3, 7, 11, 15, 19—131, and 135;
Sub-scanning 4—4, 8, 12, 16, 20—132, and 136.

Figure 4:
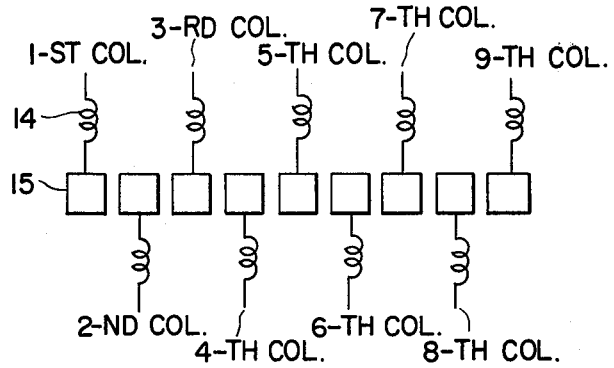
FIG. 4 is a diagram in the form of a model indicating one example of an arrangement of printing hammers and printing magnets.

The print hammers 15 and the printing magnets 14 in the printer in which the invention is applied, as shown in FIG. 4, are, in general, disposed above and below depending on the odd number columns and even number columms. They are staggered.

Described now is a method of protecting the printing magnets 14 from magnetic interference in the printer employing the above-described printing system and printing mechanism. First, a state that magnet interference most significantly affects the printing magnets 14 will be described.

If, in a group of three printing magnets 14 provided side by side, two outermost printing magnets 14 are driven substantially at the same time, and thereafter the center printing magnet 14 is driven with a very short delay time, then the flight time of the printing hammer 15 energized by the center printing magnet 14 is changed by the leakage flux of the outermost printing magnets 14. Accordingly, the character is not printed within permitted character registration, and in a worst case condition, the character is not printed.

The method to prevent this magnetic interference in accordance with this invention will be described in detail. Some of the print hammers 15 and printing magnets 14 extracted from FIG. 1 are shown in the form of an idealized model in FIG. 4. The print hammers 15 are energized by driving the printing magnets 14 connected thereto, respectively.

Referring to FIG. 4, it is assumed that in the sub-scan 1 of a print scanning the printing data coincides with types with respect to the 1st and 5th print hammers 15, and therefore the 1st and 5th print hammers 15 are energized. If, in this case, the 3rd column print hammer 15 is energized in the sub-scan 3 of the same printing scanning, the flight time of the 3rd column print hammer 15 is changed by the magnetic interference of the 1st and 5th column print hammers 15 since the former is between the latter. As a result, the character for the 3rd column is not printed within its permitted registration.

Figure 5:
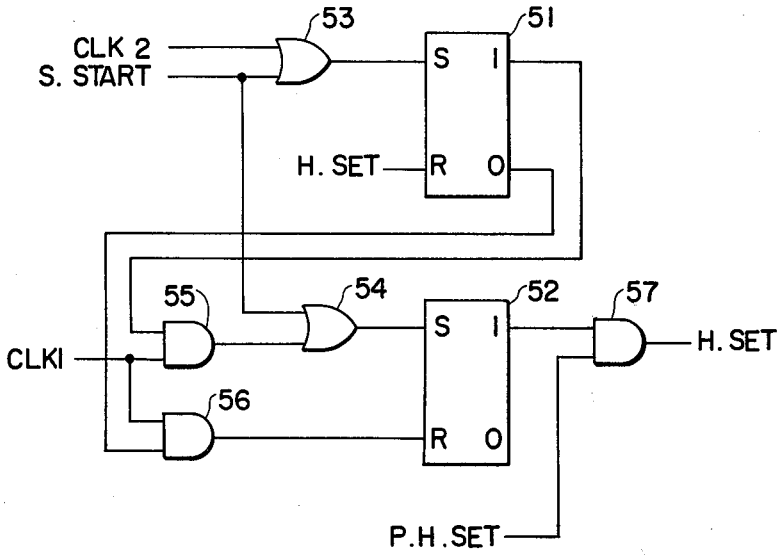
FIG. 5 is a logical circuit diagram showing one example of a magnetic interference preventing device according to this invention.
Figure 6:
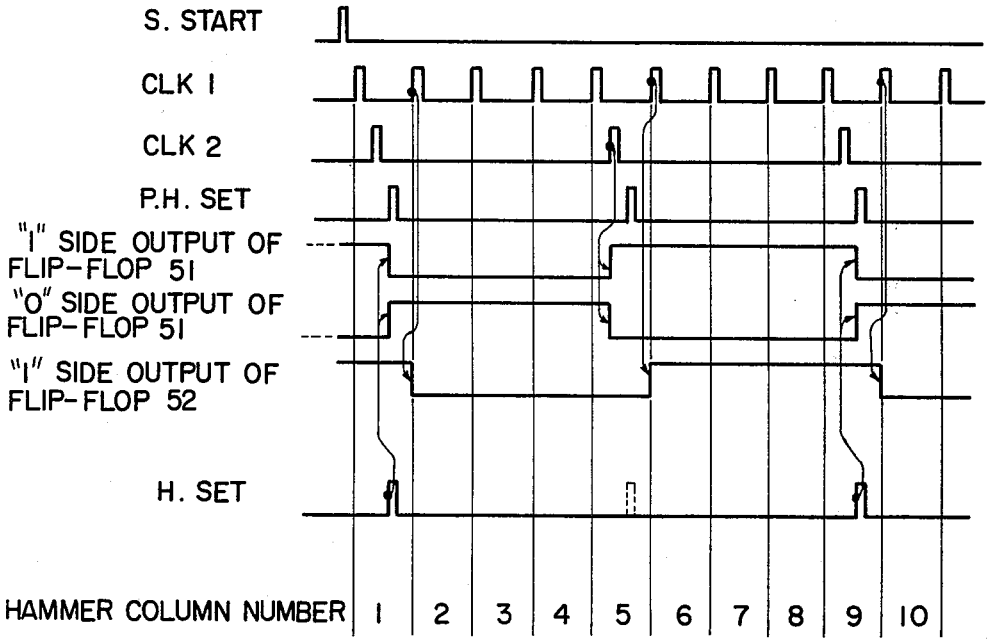
FIG. 6 is a timing chart for a description of the device shown in FIG. 5.

A logical circuit for preventing this phenomenon is shown in FIG. 5 and a timing chart indicating the operation in the sub-scan 1 is shown in FIG. 6. In FIGS. 5 and 6, reference term S.START designates a signal for starting four sub-scannings. CLK1 is a signal for counting the column numbers of the print hammers 15 one by one and CLK2 is a signal provided somewhat later than the signal CLK1 only for the column with which the confrontation is effectuated in each sub-scanning. P.H.SET is a signal which is provided somewhat later than the signal CLK2 when printing data coincides with a type with respect to a column with which confrontation is effected and H.SET is a signal for starting the driving of a printing magnet 14 for a column where printing data coincides with a type.

The operation of the logical circuit shown in FIG. 5 in the sub-scanning 1 will be described with reference to FIG. 6. FIG. 6 indicates the timing effectuated in the case where printing data coincides with types with respect to the 1st, 5th and 9th column print hammers 15 in the sub-scanning 1 of a printing scanning.

Referring to FIG. 5, when the sub-scanning is started, flip-flops 51 and 52 are set by signal S.START applied thereto through OR gates 53 and 54, respectively. With the signal CLK1, the first column print hammer 15 is specified, and the printing data is compared with a type. After the application of signal CLK1, the signal CLK2 is applied to the set input terminal of the flip-flop 51 through the OR gate 53. However, since the flip-flop 51 has been set, its output is not changed. Thereafter, if the printing data coincides with the type, the signal P.H.SET is provided.

In this case, the "1" side output of the flip-flop 52 is at a logic level "1", and therefore an AND gate 57 is opened to output the signal H.SET. As a result, the 1st column printing magnet 14 is driven, and the corresponding print hammer 15 is therefore energized. At the same time, the flip-flop 51 is reset by the signal H.SET. Therefore, the next signal CLK1 is applied through an AND gate 56 to the reset input terminal of the flip-flop 52 to reset the latter 52. Since the sub-scan 1 is carried out, data comparison is not effected for the 2nd, 3rd and 4th columns. In addition, since the signals CLK2 and P.H.SET are not generated, the outputs of the flip-flops 51 and 52 are maintained unchanged during this period.

Then, the signal CLK2 is provided for the 5th column and the flip-flop 51 is therefore set, while the flip-flop 52 is maintained reset. Accordingly, even if, with respect to the 5th column, the printing data coincides with the type and the signal P.H.SET is provided, the AND gate 57 is not opened. Hence the H.SET is not outputted. When the next signal CLK1 is provided, the flip-flop 51 is in set state. Therefore, the flip-flop 52 is set through a AND gate 55 and OR gate 54. Thereafter, with respect to the 6th, 7th and 8th columns, the outputs of the flip-flops 51 and 52 are not changed. As in the case of the 2nd, 3rd, and 4th columns.

If the printing data coincides with a type for the 9th column where confrontation is next effected, the signal P.H.SET is provided. In this case, because the flip-flop 52 is in the set state, the AND gate 57 is opened to output the signal H.SET. Therefore, the 9th column printing hammer is energized and simultaneously the flip-flop 51 is reset. The same operation as that described above is carried out for the 13th, 17th . . . and 133rd columns where confrontation is effected in the sub-scanning 1.

Figure 7:
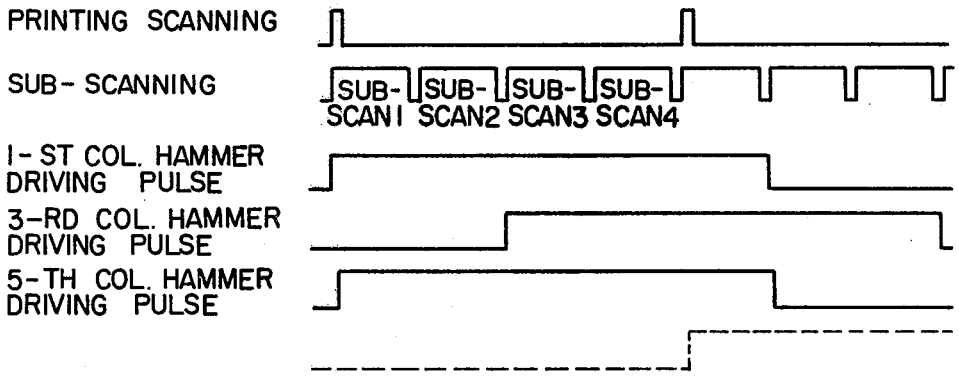
FIG. 7 is a timing chart indicating print hammer driving times in the device shown in FIG. 5.

When the 1st column print hammer 15 is energized, energization of the 5th column print hammer 15 is prohibited. Thus, as shown in the print hammer driving chart of FIG. 7, the 5th column printing hammer 15 is never energized with the timing of hammer driving pulse indicated by the solid line; that is, it is energized in the next printing scanning as indicated by the broken line. Accordingly, even when the 3rd column print hammer 15 is energized in the sub-scanning 3 of the same printing scanning as that in which the 1st column printing hammer 15 has been energized, the state that the 3rd column print hammer is most significantly affected by the magnetic interference is not provided. Accordingly, the flight time of the 3rd column print hammer is never changed.

Only the operation of the logical circuit shown in FIG. 5 in the sub-scanning 1 has been described; however, the operations of the logical circuit in the other sub-scannings are similar to that described above.

For instance, the operation in sub-scanning 2 is different from the operation described above only in that the signals CLK2 and P.H.SET are provided when the 2nd, 6th and 10th columns are specified in FIG. 6. The operation in sub-scanning 2 is apparent from the timing chart of FIG. 6. The operations in the remaining sub-scannings are similar to that in sub-scanning 2, and are different only in that the signals CLK2 and P.H.SET are provided only for columns where confrontation is effected in the respective sub-scannings. Thus, the operations of the remaining sub-scannings are also apparent from FIG. 6.

As described above, with the logical circuit shown in FIG. 5, when a certain column print hammer 15 is energized in a sub-scanning, energization of a print hammer 15 for a column where confrontation is effected next, is prohibited. Hence the occurrence of a state that the magnetic interference is most significant can be prevented for all of the columns.

According to this invention, character misregistration due to magnetic interference in a printer having relatively low price print hammers, which may be accomplished by magnetic interference, can be prevented.

The invention has been described with reference to the printer having the horizontal type carrier; however, it is apparent that the invention can be applied to a printer having a vertical type carrier. An embodiment of this invention, in which the technical concept of the invention has been applied to such a printer having a vertical type carrier, will now be described.

It is assumed that printing data and types are checked for coincidence starting at the first column in a printing scanning. If, with respect to the odd number columns, coincidence is obtained for each of two successive columns and the respective hammers 15 are energized, energization of the hammer of the following odd number column is inhibited, but thereafter energization of the hammers is permitted. Similarly, if, with respect to the even number columns, two successive column print hammers are energized, only energization of the following even number column print hammer is inhibited. If the operation is carried out in this manner, then magnetic interference can be prevented as in the above-described case.

This operation will be described in more detail with reference to FIG. 4. When the 1st and 3rd column print hammers 15 are energized as coincidence is obtained for each of the 1st and 3rd columns, in a printing scanning, energization of the following odd number column, or the 5th column, print hammer 15 is inhibited, while energization of the remaining odd number (the 7th, 9th, 11th and so on) print hammers are permitted. Similarly, if the 7th and 9th column print hammers 15 are energized, energization of only the 11th column print hammers is inhibited, while energization of the following column (the 13th, 15th, 17th and so on) print hammers is permitted. This can be applied to the even number columns. That is, if the 2nd and 4th column print hammers 15 are successively energized, energization of the 6th column print hammer 15 only is inibited, but energization of the following columns (the 8th, 10th 12th and so on) is permitted.

Thus, the character misregistration due to the magnetic interference can be prevented in the printer having the vertical type carrier also.

Figure 8:
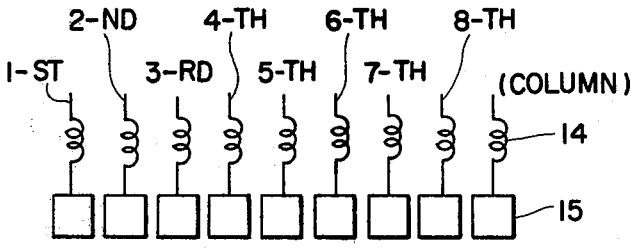
FIG. 8 is a diagram in the form of a model showing another example of an arrangement of printing hammers and printing magnets.

According to another embodiment of this invention, character misregistration due to magnetic interference can be prevented also in a printer in which all of printing magnets 14 are disposed side by side as shown in FIG. 8. This embodiment will now be discribed in detail.

In a print scanning, when two adjacent printing magnets 14 are driven, energization of the following printing magnet 14 is stopped. More specifically, when the 1st and 2nd column printing magnets 14 are driven in a printing scanning, driving the 3rd column printing magnet 14 is inhibited, but driving the remaining column (the 4th, 5th, 6th and so on) printing magnets 14 is permitted. Similarly, if the 4th and 5th column printing magnets 14 are successively driven, driving the 6th column printing magnet 14 is inhibited, but driving the following column (the 7th, 8th, 9th and so on) printing magnets 14 is permitted. In addition, similarly as in the above-described cases, if the 2nd and 3rd column printing magnets 14 are driven, driving the 4th column printing magnet 14 is inhibited; and if the 3rd and 4th column printing magnets 14 are driven, driving the 5th column printing magnet 14 is inhibited. Thus, the character misregistration due to the magnetic interference can be positively prevented.

It is apparent that other modifications of this invention are possible without departing from the essential scope of this invention.

We claim:

1. A magnetic interference prevention system in a printer, comprising a plurality of print hammers having their respective hammering surfaces disposed in a straight line, a plurality of printing magnets arranged adjacent one another to drive respective print hammers, and means responsive to signals for actuating said magnets for preventing simultaneous energization of three adjacent magnets while permitting simultaneous energization of two adjacent magnets.

2. A system of claim 1 wherein said means responsive to signals for actuating said magnets comprises a logic network responsive to signals indicative of confrontation of printing type in a position to be printed.

3. A system of claims 1 or 2 further comprising a type belt, said belt having timing marks thereon, and means to sense said timing marks.

4. A system of claim 3 wherein said type belt is disposed in a horizontal direction.

5. A magnetic interference prevention system in a printer, said printer comprising a plurality of print hammers having their respective hammering surfaces disposed in a straight line, a plurality of printing magnets arranged adjacent one another to drive respective print hammers and means for energizing said print hammers in response to actuating signals, said printer further comprising signal generating means for generating a first scanning signal, first signals sequentially specifying said print hammers, second signals representing particular hammers which are permitted to be energized and which are displaced in time with respect to said first signals, and signals indicative of confrontation of printing type with a print hammer, said magnetic interference prevention system comprising:

a first flip-flop having set and reset inputs, an output and an inverted output;

a second flip-flop having set and reset inputs and an output;

a first AND gate receiving as inputs said second flip-flop output and said signal indicative of confrontation of printing type with a print hammer, the output of said first AND gate providing said actuating signals and being coupled to the reset input of said first flip-flop;

a first OR gate receiving said scanning signal as a first input and receiving said second signals as a second input and providing an output signal to the set input of said first flip-flop;

a second OR gate receiving said scanning signal as a first input and providing an output signal to the set input of said second flip-flop;

a second AND gate receiving as inputs said first signals and the output of said first flip-flop, the output of said second AND gate being coupled as a second input to said second OR gate; and a third AND gate receiving as inputs said first signals and the inverted output from said first-flop, the output of said third AND gate being coupled to the reset input of said second flip-flop;

the output of said first AND gate providing said actuating signals and being coupled to the reset input of said first flip-flop whereby said interference prevention system is responsive to said actuating signals for inhibiting the driving of at least one of two adjacent magnets for a predetermined period of time to thereby prevent magnetic interference between simultaneously energized magnets.

6. The system of claim 5 wherein said first signals are indicative of the columns for said print hammers.

7. The system of claim 5 wherein said confrontation signals are displaced in time with respect to said second signals.

* * * * *